United States Patent [19]

Franklin

[11] 4,028,541

[45] June 7, 1977

[54] LUMINAIRE

[75] Inventor: John S. Franklin, Hendersonville, N.C.

[73] Assignee: General Electric Company, New York, N.Y.

[22] Filed: Nov. 11, 1974

[21] Appl. No.: 522,439

[52] U.S. Cl. ..... 240/25; 240/41 L; 240/41 SC

[51] Int. Cl.[2] ..... F21S 1/10; F21S 3/10; F21S 13/10

[58] Field of Search ..... 240/25, 3, 11.4 R, 44.2, 240/41 SC, 41 L

[56] References Cited

UNITED STATES PATENTS

| | | | |
|---|---|---|---|
| 2,970,222 | 1/1961 | Husby et al. | 240/25 X |
| 3,116,023 | 12/1963 | Van Dusen et al. | 240/3 |
| 3,284,622 | 11/1966 | Moore | 240/11.4 R X |
| 3,315,072 | 4/1967 | Harling | 240/25 |
| 3,457,399 | 7/1969 | Milroy | 240/25 |
| 3,459,934 | 8/1969 | Moore | 240/11.4 R X |
| 3,492,473 | 1/1970 | Jablonski | 240/25 |
| 3,530,287 | 9/1970 | Husby | 240/25 |
| 3,662,164 | 5/1972 | Wood | 240/25 |
| 3,836,954 | 9/1974 | Adams | 240/25 |
| 3,852,583 | 12/1974 | Puyplat | 240/41 SC X |

*Primary Examiner*—Fred L. Braun
*Attorney, Agent, or Firm*—Sidney Greenberg

[57] ABSTRACT

An outdoor luminaire has a housing of generally rectangular shape enclosing a combined closure and optical assembly which comprises a cover glass, reflector and lamp holder and is readily removable as a unit from the housing. The lamp holder with attached lamp is removable through an aperture in the reflector which is closed by a cover attached to the lamp holder. Electrical ballast components for operating the lamp are mounted on a removable tray located in the luminaire housing to the rear of the optical assembly and below a pipe clamp which fastens the luminaire to a support pipe. An adjustable shield is located at the rear wall of the luminaire to cover the opening around the pipe support to prevent entry of birds, rainwater and the like.

4 Claims, 10 Drawing Figures

1
1a
1b
1c
1d
1e
2
3
4
5
5a
6
6a
7
8
9
10
10b
11
12
13
14
15
18
19
21
28
29
30
31
34
38
A
B

LUMINAIRE

The present invention relates to luminaires, and in particular concerns outdoor luminaires of enclosed type suitable for street, highway and area lighting purposes.

It is an object of the invention to provide a luminaire of the above type having a closure means which enables ready access to the electrical and optical components of the luminaire for servicing thereof.

Another object of the invention is to provide a luminaire of the above type which has a sealed optical assembly and means for purifying the air which passes into the interior thereof.

Still another object of the invention is to provide a luminaire of the above type which is economically manufactured, easily assembled, and readily maintained while in installed position.

A particular object of the invention is to provide a luminaire of the above type having a combined closure and optical assembly removable as a unit from the luminaire.

Another particular object of the invention is to provide a novel lamp holder asembly for luminaires of the above type which is readily removable from the optical assembly and replaceable thereon in sealed relation.

Still another object of the invention is to provide a ballast assembly for luminaires of the above type which is readily removable as a unit from the luminaire.

Still a further object of the invention is to provide a luminaire of the above type having an adjustable shield at the rear support opening thereof for preventing entry of birds, rainwater and the like into the luminaire housing.

Other objects and advantages will become apparent from the following description and the appended claims.

With the above objects in view, the present invention in one of its preferred embodiments relates to a luminaire comprising, in combination, a housing having a top wall, opposite side walls, a front wall and a rear wall defining a housing chamber and a bottom wall extending forwardly from the rear wall covering a portion of the bottom of the housing chamber and defining with the side walls and the front wall a bottom opening at the front portion of the housing chamber, and a combined closure and optical assembly arranged in the front portion of the housing chamber detachably secured to the housing for movement as a unit to a closed operative position covering the bottom opening and an open inoperative position away from the bottom opening, the combined closure and optical assembly comprising a concave reflector, a light transmitting member and frame means joined together and defining an optical enclosure, the concave reflector having a front side formed with an aperture, and combined lamp holder and cover means detachably mounted on the reflector covering the front aperture therein and having lamp support means extending through the front aperture for holding a lamp within the optical enclosure.

In a particularly preferred embodiment of the invention, a unitary ballast assembly is arranged in the rear portion of the housing chamber and is removable as a unit from the housing through the bottom opening.

The invention will be better understood from the following description taken in conjunction with the accompanying drawings, in which.

Figures 1, 2:
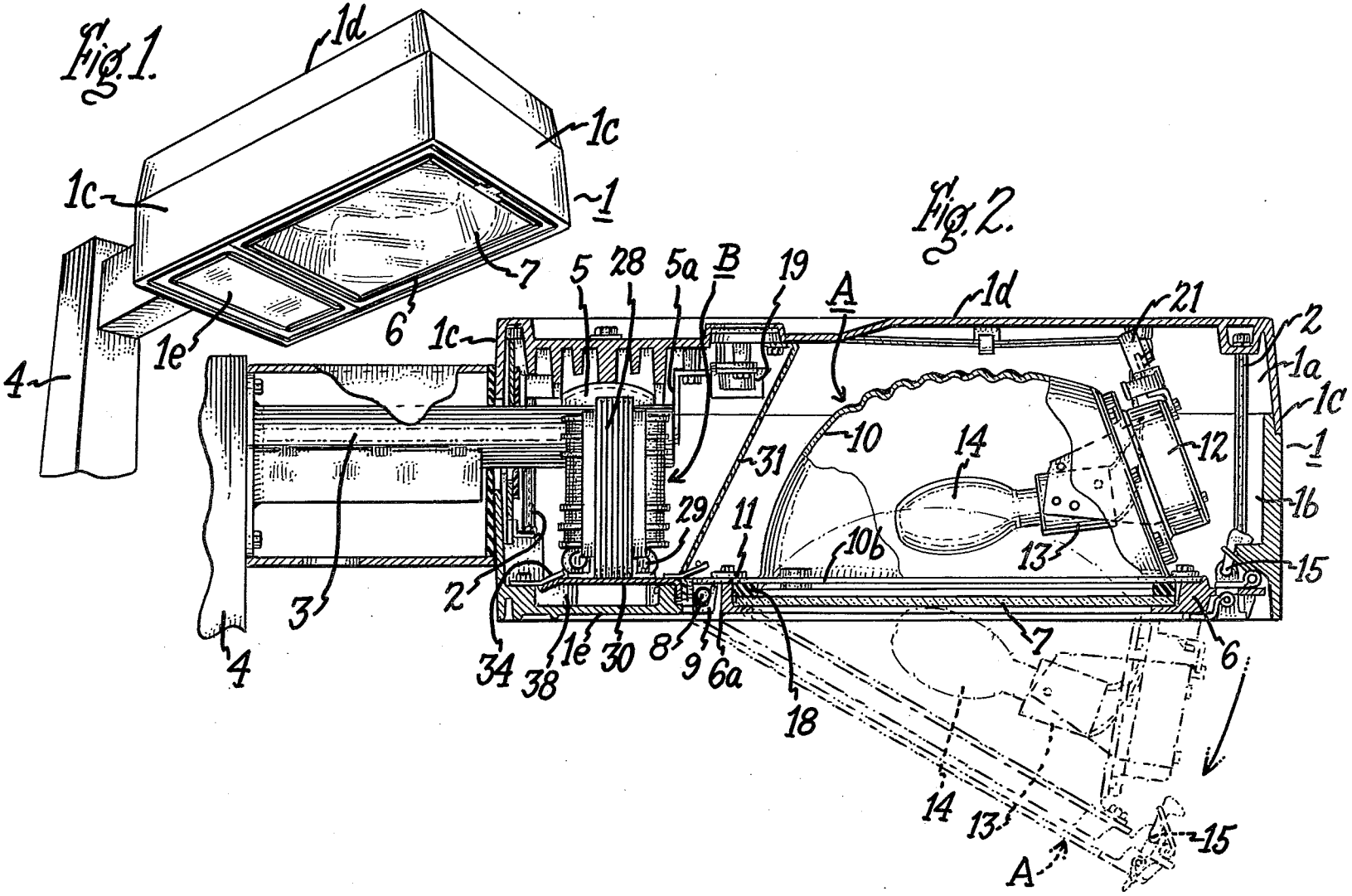
FIG. 1 is a perspective view of a luminaire in which the invention may be embodied.
FIG. 2 is an elevational view, partly in section, of the luminaire.

Referring now to the drawings, and particularly to FIGS. 1 and 2, there is shown an outdoor luminaire in which the invention is embodied comprising a rectangular box-like housing constituted in the illustrated embodiment of upper and lower housing portions 1*a*,1*b* joined together by bolts 2 at the corners of the housing. Composite housing 1 has four side walls 1*c*, top wall 1*d* and bottom wall 1*e* integral with lower housing portion 1*b* covering the bottom portion of the housing chamber. Housing 1 is mounted at its rear end on a pole 4 by means of a horizontal support, such as a pipe bracket 3 which projects through the rear wall 1*c* and is clamped by adjustable slipfitter 5 in the housing interior (see FIG. 3).

Bottom wall 1*e* and housing side walls 1*c* define an opening at the forward portion of housing 1 in which is arranged a closure comprising frame 6 in which light-transmitting panel 7 such as a plain or refractive glass pane is mounted and which is hingedly secured at its rear to housing 1 by hinge pins 8 at opposite sides thereof detachably engaging hinge seats 9 formed adjacent bottom wall 1*e* of the housing. At its front end, frame 6 is releasably attached to housing 1 by latch 15. The structure and operation of the particular latch device shown is disclosed in detail in copending application Ser. No. 507,758, now U.S. Pat. No. 3,918,751 issued Nov. 11, 1975 assigned to the same assignee as the present invention, but, as will be understood, various other types of latch devices may be used instead, if desired.

While panel 7 is shown as a flat glass pane, it will be understood that other forms of light transmitting closures may be used such as a dished or bowl-shaped glass or plastic member.

Figure 5:
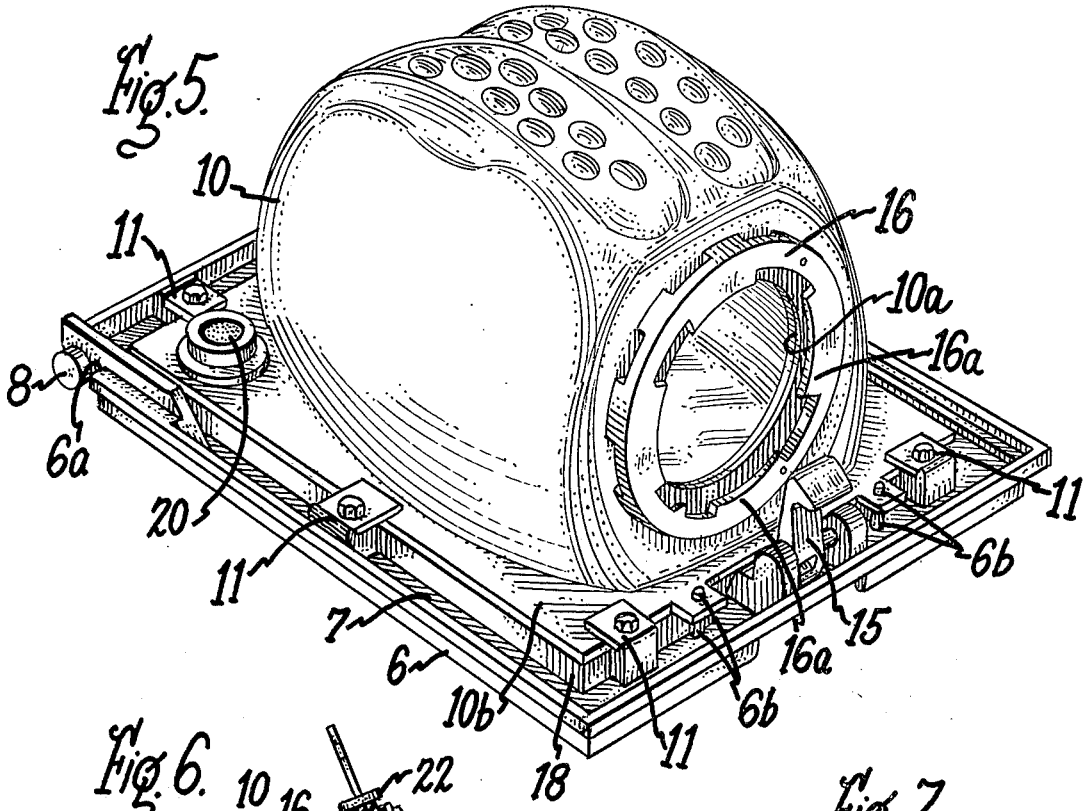
FIG. 5 is a perspective view of the combined closure and optical assembly of the luminaire with the lamp holder device removed from the reflector opening.

Arranged on glass panel 7 in sealed relation with the upper marginal surface thereof is concave reflector 10 formed with bottom flange 10*b* secured to frame 6 by spaced clips 11 (see FIG. 5). On its front side reflector 10 has a circular opening 10*a* closed by lamp holder housing or canister 12 (see FIG. 6) which has adjustably secured thereto lamp socket 13 in which lamp 14 is removably secured at its base and extends into the interior of concave reflector 10, as seen in FIG. 2. Reflector 10, lamp holder housing 12 and closure panel 7 mounted on frame 6 thus form a combined closure and optical assembly A which is hingedly attached to housing 1 and is swingable as a self-contained unit from an installed position covering the bottom housing opening to a lowered position away from the bottom opening, as shown in interrupted lines in FIG. 2, to thereby provide access to the assembly for re-lamping or other servicing operations, as more fully described below.

Figure 6:
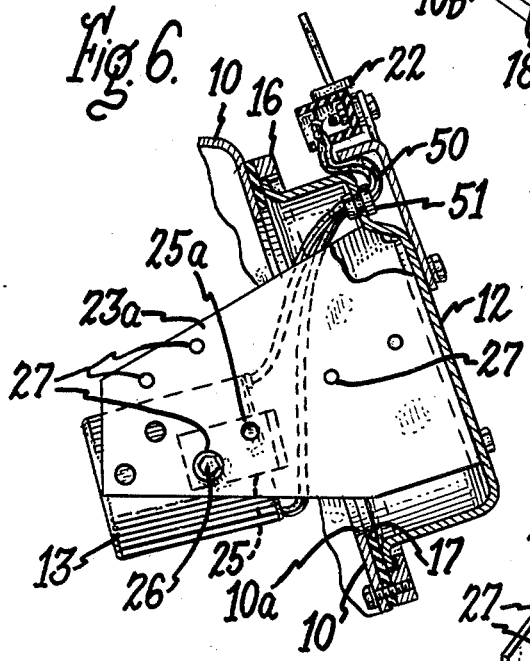
FIG. 6 is an elevational view, partly in section, of the luminaire lamp holder device installed covering the reflector opening.
Figure 7:
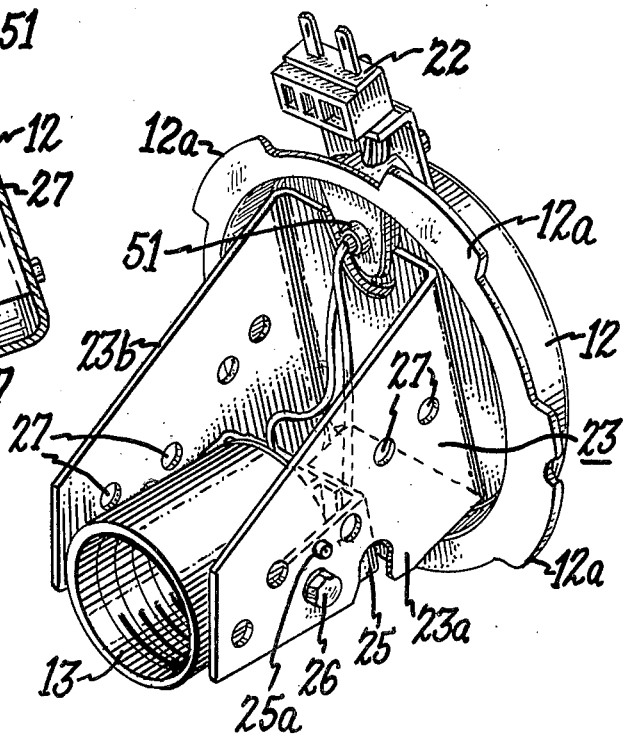
FIG. 7 is a perspective view of the lamp holder device as seen from the inner side.

As seen in FIGS. 6 and 7, U-shaped support bracket 23 is secured at its web portion to the inside of cup-shaped canister 12 so that its opposite parallel arms 23*a*,*b* project rearwardly. Lamp socket 13 is secured between bracket arms 23*a*,*b* by means of inner U-shaped socket bracket 25 which has detents 25*a* projecting from opposite arms and is attached to outer bracket 23 by screws 26. Bracket arms 23*a*,*b* have a plurality of corresponding longitudinally and vertically spaced apertures 27 into which detents 25*a* and screws 26 may be selectively inserted to longitudinally and vertically adjust socket 13 to obtain the desired light distribution from lamp 14, as well understood by those skilled in the art.

Lamp holder canister 12 is detachably secured to reflector 10 by quick-disconnect flange or bayonet-type attaching means comprising annular member 16 secured to reflector 10 surrounding its front opening 10*a* (see FIG. 5). Ring 16 is formed with circumferentially spaced inwardly directed lugs 16*a* adapted to engage complementary projections 12*a* formed on the rim of canister 12 (see FIG. 7), such that when canister 12 is arranged with projections 12*a* inserted through the spaces between lugs 16*a* and twisted, projections 12*a* engage lugs 16*a* and lock canister 12 in position on reflector 10 closing the opening in the front wall thereof. There is thus provided an optical enclosure which is preferably provided with air-tight sealing means comprising annular gasket 17 between the mating parts of canister 12 and reflector 10 as seen in FIG. 6, and gasket 18 arranged between reflector flange 10*b* and glass panel 7 as seen in FIGS. 2 and 5. The passage in canister 12 through which leads 50 pass is sealed by resilient grommet 51. Air filter 20 comprising a tubular holder containing suitable air purifying material such as activated charcoal particles is arranged extending into the thus sealed optical enclosure through reflector flange 10*b* to prevent entry of contaminants therein while allowing passage of air into and out of the enclosure. The structure and operation of air filter 20 are more fully described in the U.S. Pat. to Milroy No. 3,457,399, assigned to the same assignee as the present invention.

An automatic quick-disconnect electrical connection provided in the luminaire comprises a receptacle 21 loosely fixed to the upper forward portion of housing 1 (see FIG. 2) and a two-prong plug 22 attached to the top of lamp holder canister 12, such that when combined closure and optical assembly A is moved into closed position and latched, plug 22 is received in receptacle 21 to automatically provide an electrical connection for operating lamp 14. When assembly A is lowered as shown in FIG. 2, the electrical connection between plug 22 and receptacle 21 is automatically broken, thus avoiding any electrical shock hazard to personnel servicing the optical assembly. To aid in aligning the mating disconnect parts, pins 6*b* integral with frame 6 are provided for engaging holes in reflector flange 10*b* as seen in FIG. 5.

To replace the lamp in the optical assembly A or permit other maintenance service thereon, assembly A is unlatched and lowered while hingedly attached at its rear end to housing 1, then canister 12 is rotated to disengage the flange-type bayonet connection to reflector ring 16, and the lamp holder assembly including lamp 14 is withdrawn through opening 10*a* in reflector 10 to provide ready access to the lamp and socket for necessary servicing and adjustment.

In order to entirely remove assembly A from the luminaire housing, frame 6 is unlatched at its front end and lowered a distance not more than about 30° from its closed position, thereby enabling the rear end of the assembly to be raised so that hinge pins 8 can be lifted out of hinge seats 9 and permitting complete removal of assembly A. If the latter assembly is lowered more than about 30° or is hanging vertically from hinge seats 9, it cannot be removed from the luminaire housing because interference between the rear edge face 6*a* of frame 6 and hinge seats 9 in such positions of assembly A will prevent lifting out of hinge pins 8 from hinge seats 9. This feature prevents inadvertent detachment of assembly A from the housing in the event it is allowed to drop or swing free after being unlatched.

Figures 3, 4:
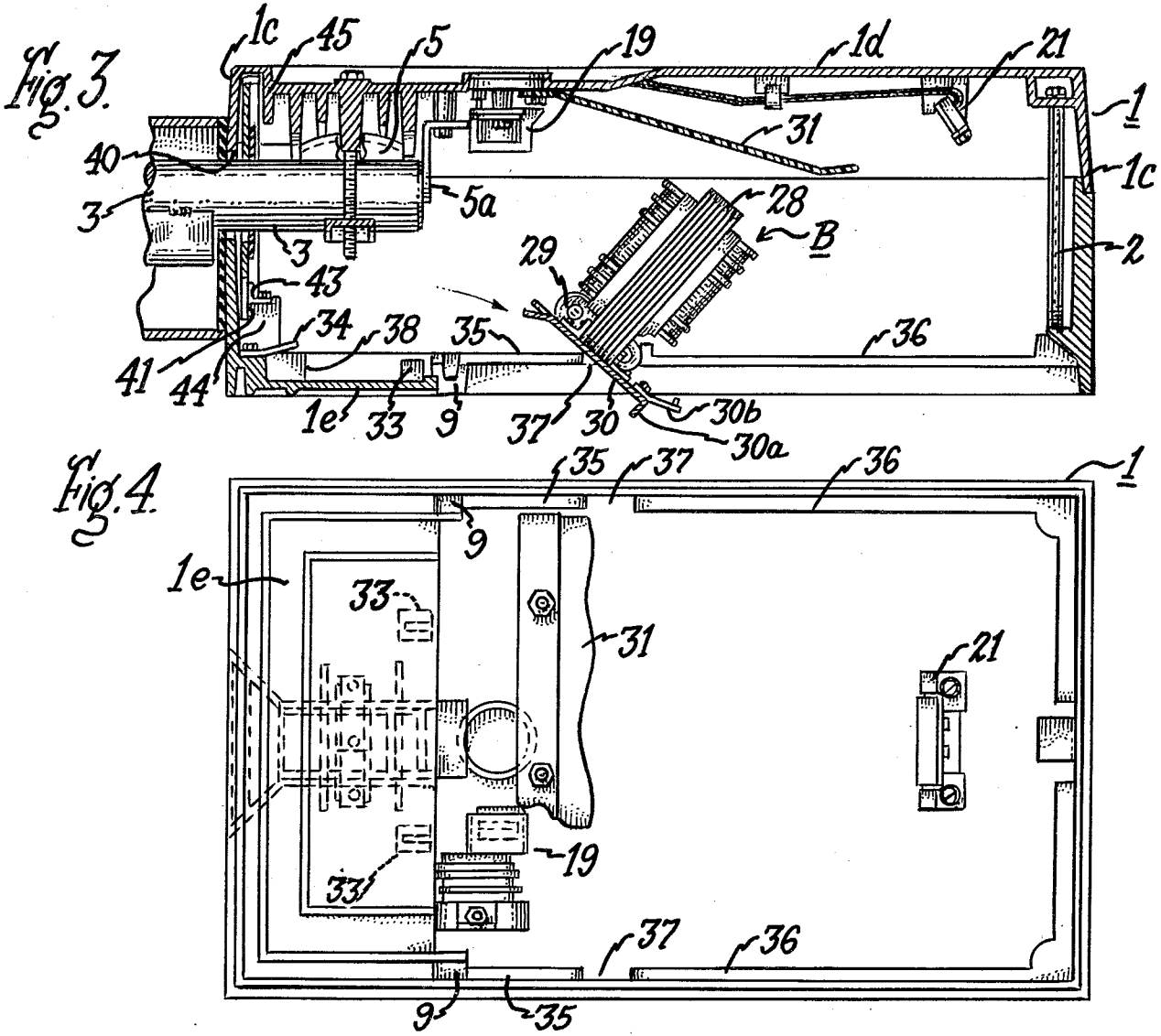
FIG. 3 is a similar view of the luminaire, showing the ballast assembly partly withdrawn from the housing.
FIG. 4 is a bottom plan view of the luminaire housing with closure and ballast assemblies removed.
Figure 8:
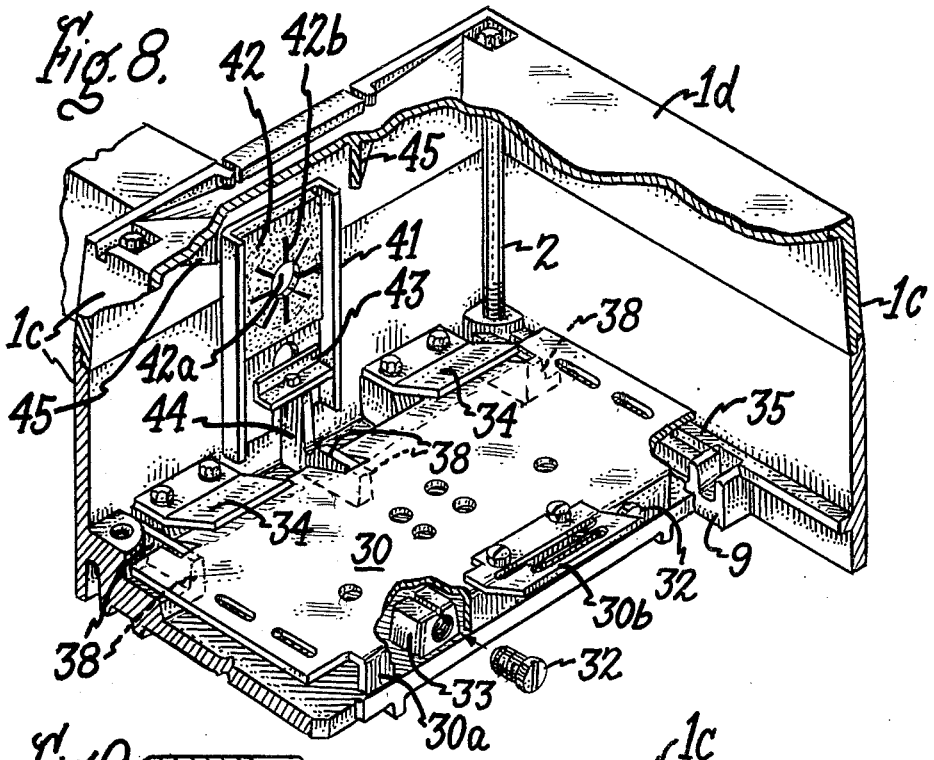
FIG. 8 is a view in perspective of the rear portion of the luminaire and associated structure including an adjustable bird shield device.
Figure 9:
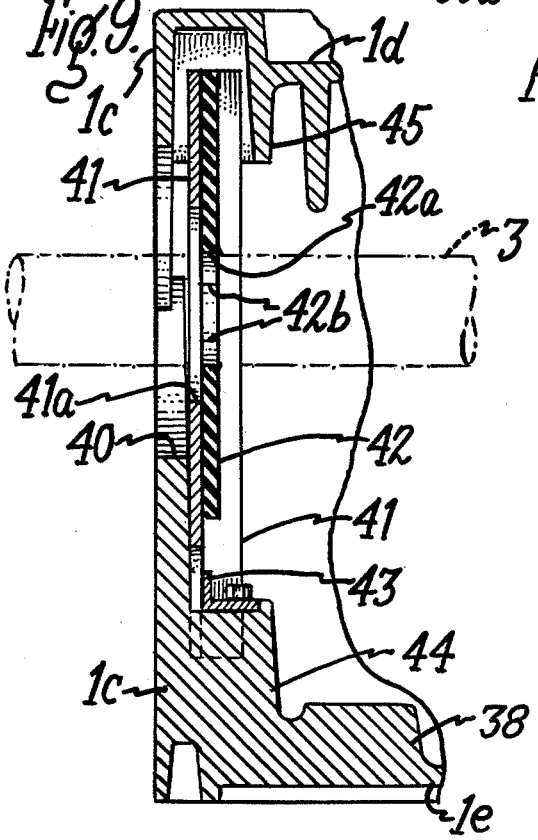
FIG. 9 is a side view in cross-section of the bird shield device shown in FIG. 8.

In accordance with another feature of the invention, electrical ballast components including transformer 28 and capacitor 29 (see FIG. 2) for operating lamp 14, which is typically of a high intensity gaseous discharge type such as a mercury or sodium vapor lamp, are mounted on a removable base or tray 30 located on bottom wall or shelf 1*e* at the rear portion of the housing chamber, and the ballast assembly B thus provided is removable as a unit from the housing, as described below. Preferably, a displaceable flap 31 comprising a stiff sheet of electrical insulating material, secured at its top to housing 1 as seen in FIG. 2, is provided to serve as a protective shield or barrier to prevent inadvertent contact by service personnel with the electrical operating components in the rear compartment when assembly A is lowered or removed. As seen best in FIG. 8, tray 30 is forced of a flat metal plate having a front flange 30*a* and slotted handle 30*b* attached to the upper front surface of the tray. In the installed position, tray 30 is secured at its front flange 30*a* by screws 32 to bosses 33 at the front of bottom shelf 1*e* with its rear edge resting on spaced bosses 38 at the rear of shelf 1*e* and inserted under spaced retaining tabs 34 secured at the rear housing wall 1*c*. As shown, retaining tabs 34 are angled upwardly somewhat to facilitate insertion of the downwardly sloping rear portion of tray 30. In such installed position, the side edge portions of tray 30 rest on support ledges 35 extending along opposite side walls of housing 1 (see FIGS. 4 and 8). Support ledges 35 are spaced at their front ends from stop ledges 36, which serve to stop the upward travel of closure frame 6 in its closing movement, so as to leave gaps 37 at opposite sides. To remove ballast assembly B, after insulating flap 31 is swung out of the way as seen in FIG. 3, and electrical connections to the ballast are removed, screws 32 are removed and handle 30*b* is grasped to pull ballast assembly B forward. During such forward movement tray 30 slides along support ledges 35 until it reaches opposite gaps 37, at which point tray 30 may now be pulled downwardly out of housing 1 with its lateral edges passing through gaps 37 to completely remove ballast assembly B from the luminaire, as seen in FIG. 3. To re-install the ballast assembly B in the housing, the reverse procedure is employed.

Located in the rear compartment of the housing 1 interior above ballast assembly B is slipfitter 5 which comprises a pipe clamp and adjustable bearing means for providing the desired angle of tilt of the luminaire. Such a slipfitter construction is described in detail in Baldwin U.S. Pat. No. 3,387,866, assigned to the same assignee as the present invention. It will be understood, however, that other forms of slipfitters or pipe clamps may be used if desired. A pipe stop 5*a* is provided to limit the forward position of pipe support 3.

Also located in the rear compartment is electrical terminal board 19 at which wiring connections between the ballast components and electrical receptacle 21 may be made.

In accordance with another feature of the invention, an adjustable bird shield is provided at the pipe-receiving aperture in the back wall of luminaire housing 1 to cover any openings between pipe support 3 and the housing wall. As seen in FIG. 3, an oversize hole 40 is provided in rear wall 1*c* of housing 1 to accommodate pipe supports 3 of various sizes, and to allow tilting or leveling adjustment of housing 1 thereon. To prevent entry of birds and the like through the resultant gap around the pipe support, a vertically slidable plate 41 (see FIG. 8) is provided inside the rear housing wall having an aperture 41*a* therein large enough to pass the largest pipe support to be used. Adhesively attached to plate 41 overlying aperture 41*a* is a rubber sheet 42 having a hole 42*a* concentric with aperture 41*a* and having slits 42*b* radiating from hole 42*a* so as to accommodate pipe supports of different diameters. Guide member 43 secured to boss 44 on housing bottom wall 1*e* serves to retain plate 41 in position while allowing it to slide up and down as necessary when housing 1 is moved vertically or tilted relative to pipe support 3. At its upper end, slidable plate 41 is retained in position by boss 45 at the top of housing 1. The bottom edge of plate 1 is slotted to accommodate boss 44.

Figure 10:
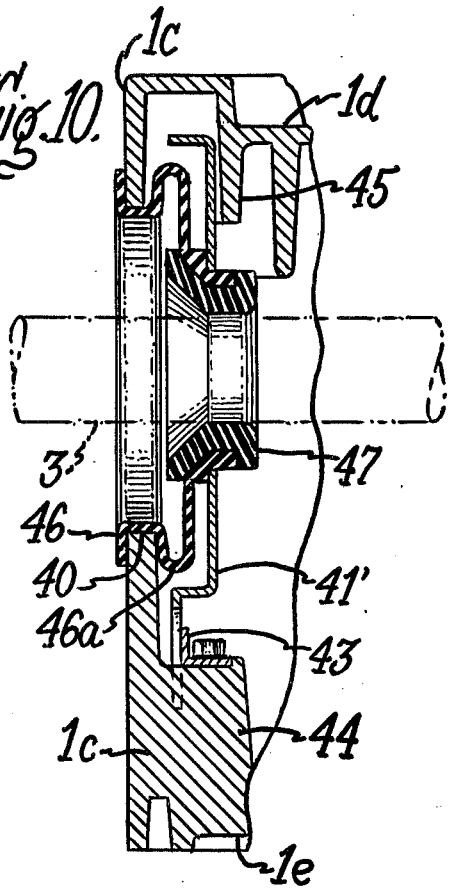
FIG. 10 is a similar view of a modified bird shield device.

FIG. 10 shows a modified form of the bird shield device which may be employed to provide greater protection against entry of rainwater into the rear compartment of the luminaire. This shield device comprises a rubber boot 46 having an annular groove at its rear side receiving the edge of hole 40 in rear housing wall 1*c* and adhesively attached thereto and having a front flanged portion inserted into the aperture in slidable plate 41', which is of modified shape to accommodate rubber boot 46. Tubular rubber insert 47 arranged concentrically within the flanged front end of boot 46 has an inner diameter dimensioned to tightly fit around pipe support 3 extending therethrough as shown for sealing this region against rainwater. The intermediate bellows portion 46*a* of boot 46 between the front and rear portions thereof provides the necessary flexibility to allow slidable vertical adjustment of plate 41' in the manner and for the purposes as described above. Rubber insert 47 is readily removable to accommodate a larger diameter pipe support 3, and in that case the inner end of boot 46 itself engages the pipe support.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A luminaire comprising, in combination, a housing having a top wall, opposite side walls, a front wall and a rear wall defining a housing chamber and a bottom wall extending forwardly from said rear wall covering a portion of said housing chamber and defining with said side walls and said front wall a bottom opening at the front portion of said housing chamber, and a combined closure and optical assembly arranged in said front portion of said housing chamber detachably secured to said housing for movement as a unit to a closed operative position covering said bottom opening and an open inoperative position away from said bottom opening, said combined closure and optical assembly comprising a concave reflector, a light transmitting member and frame means joined together and defining an optical enclosure, said concave reflector having a front side formed with an aperture, and combined lamp holder and cover means detachably mounted on said reflector covering said front aperture therein and having lamp support means extending through said front aperture for holding a lamp within said optical enclosure, said front aperture being sufficiently large for passage of the lamp therethrough so that said lamp support means with lamp attached thereto is removable as a unit from said optical enclosure upon detachment from said reflector, and coacting separable electric connecting means on said housing and said combined closure and optical assembly adjacent said front wall for automatically making and breaking electrical connection between the lamp and an electrical supply upon respectively closing and opening said combined closure and optical assembly.

2. A luminaire comprising, in combination, a housing having a top wall, opposite side walls, a front wall and a rear wall defining a housing chamber and a bottom wall extending forwardly from said rear wall covering a portion of said housing chamber and defining with said side walls and said front wall a bottom opening at the front portion of said housing chamber, and a combined closure and optical assembly arranged in said front portion of said housing chamber detachably secured to said housing for movement as a unit to a closed operative position covering said bottom opening and an open inoperative position away from said bottom opening, said combined closure and optical assembly comprising a concave reflector, a light transmitting member and frame means joined together and defining an optical enclosure, said concave reflector having adjacent said front wall a front side formed with an aperture facing said front wall, and combined lamp holder and cover means detachably mounted on said reflector covering said front aperture therein and having lamp support means extending through said front aperture for holding a lamp within said optical enclosure, said front aperture being sufficiently large for passage of the lamp therethrough so that said lamp support means with lamp attached thereto is removable as a unit from said optical enclosure upon detachment from said reflector, and electrical operating means comprising a tray member and electrical ballast components secured to said tray member and forming therewith a unitary ballast assembly; said tray member having a front portion and a rear portion, means detachably securing said tray member at its front portion to said bottom wall, means on said housing adjacent the rear portion of said tray member separably engaging the same for retaining said tray member in installed position, elongated support means on opposite side walls of said housing in the region of and extending along said bottom wall, said tray member resting on said support means and slidably movable thereon during removal from said housing.

3. A luminaire as defined in claim 2, and handle means on said front portion of said tray member for moving said unitary ballast assembly toward said bottom opening for removal thereof from said housing.

4. A luminaire comprising, in combination a housing having a top wall, opposite side walls, a front wall and a rear wall defining a housing chamber and a bottom wall extending forwardly from said rear wall covering a portion of said housing chamber and defining with said side walls and said front wall a bottom opening at the front portion of said housing chamber, and a combined closure and optical assembly arranged in said front portion of said housing chamber detachably secured to said housing for movement as a unit to a closed operative position covering said bottom opening and an open inoperative position away from said bottom opening, said combined closure and optical assembly comprising a concave reflector, a light transmitting member and frame means joined together and defining an optical enclosure, said concave reflector having adjacent said front wall a front side formed with an aperture facing said front wall, and combined lamp holder and cover means detachably mounted on said reflector covering said front aperture therein and having lamp support means extending through said front aperture for holding a lamp within said optical enclosure, said front aperture being sufficiently large for passage of the lamp therethrough so that said lamp support means with lamp attached thereto is removable as a unit from said optical enclosure upon detachment from said reflector, one of said side walls having an aperture therein for receiving an elongated support, slipfitter means in said housing adjacent said aperture for adjustably mounting said housing on the elongated support, and adjustable shield means arranged adjacent said one side wall for closing any opening between said housing and the elongated support in different adjusted positions of said housing, said adjustable shield means comprising plate means slidably arranged along said one side wall and having an aperture therein in register with said side wall aperture for receiving the elongated support, and resilient means on said plate means extending around and overlapping said aperture therein for yieldably engaging the elongated support adapted to extend therethrough, said resilient means including a tubular resilient member inserted through said aperture in said plate means.

* * * * *